United States Patent [19]

Kolb et al.

[11] 4,248,355

[45] Feb. 3, 1981

[54] CLOSURE FOR SAMPLE VIALS

[75] Inventors: Bruno Kolb, Owingen; Dietrich Boege, Daisendorf; Peter Pospisil; Hubert Riegger, both of Überlingen, all of Fed. Rep. of Germany

[73] Assignee: Bodenseewerk, Perkin-Elmer & Co., GmbH, Überlingen, Fed. Rep. of Germany

[21] Appl. No.: 63,629

[22] Filed: Aug. 3, 1979

[30] Foreign Application Priority Data

Aug. 4, 1978 [DE] Fed. Rep. of Germany ..... 2834186

[51] Int. Cl.[3] ..... B65D 41/20; B65D 51/16; B01L 3/12

[52] U.S. Cl. ..... 215/274; 215/260; 422/102

[58] Field of Search ..... 422/102; 220/203, 207, 220/209, 356, 357, 366, 367; 215/248, 249, 260, 270, 271, 350, 274

[56] References Cited

U.S. PATENT DOCUMENTS

| | | | |
|---|---|---|---|
| 1,865,764 | 7/1932 | Keenan | 215/260 |
| 2,102,158 | 12/1937 | Keaney et al. | 220/209 X |
| 3,424,329 | 1/1969 | Hershberg et al. | 215/DIG. 3 X |
| 3,552,591 | 1/1971 | Wimmer | 215/DIG. 3 X |
| 3,851,782 | 12/1974 | Clawson et al. | 215/307 |
| 4,057,168 | 11/1977 | Bosshold | 215/260 X |
| 4,105,133 | 8/1978 | LaBarge et al. | 220/DIG. 27 X |

*Primary Examiner*—Arnold Turk

*Attorney, Agent, or Firm*—Salvatore A. Giarratana; Edwin T. Grimes; Francis L. Masselle

[57] ABSTRACT

Closure for a sample vial utilized to introduce sample into a gas chromatograph in accordance with the head space method. The closure includes a flexible disc for closing the opening through the neck of the vial and overlying the margin of the neck about the vial opening. A cap having a central aperture defining an annular shoulder about the aperture overlies the disc. The cap has an annular depending skirt encompassing the disc for clamping about the neck of the vial to retain the disc and the cap on the vial. A portion of the closure is deformable for venting the vial to atmosphere in response to a pressure within the vial when the closure is applied thereto in excess of a predetermined pressure.

4 Claims, 4 Drawing Figures

FIG. 1
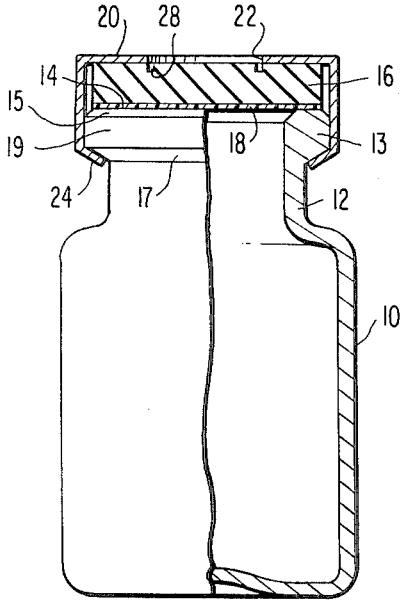
FIG. 2
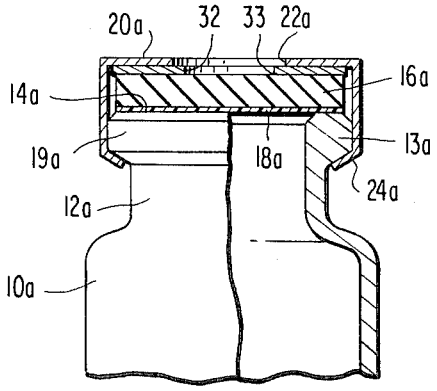
FIG. 3
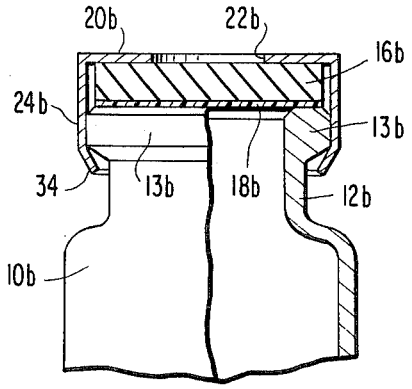
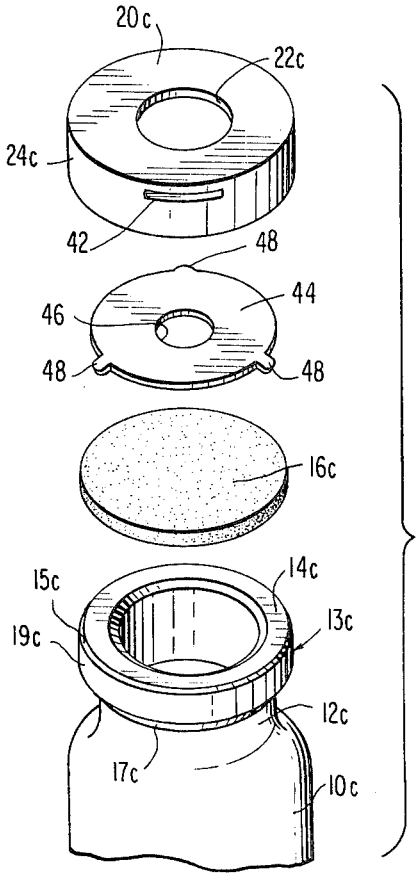
FIG. 4

CLOSURE FOR SAMPLE VIALS

BACKGROUND OF THE INVENTION

The present invention relates to a closure for sample vials or vessels for introducing samples into a gas chromatograph utilizing the vapour space (head space) method and particularly relates to a closure for sample vials of the type having a rubber disc retained within a metal cap having a central aperture, the metal cap including a rim deformed about a circumferential bead at the neck of the sample vial.

In the vapour space method, hereafter called head space method, of introducing a sample into a gas chromatograph, a sample vial is filled with a sample liquid and is closed at the top by a self-sealing rubber disc or septum. The sample vial is then heated to a predetermined temperature. The injection section of the gas chromatograph includes a needle which, by means of a suitable mechanism, pierces the rubber disc and extends into the head space above the level of the liquid in the sample vial. The needle lies in communication with the separating column inlet of the gas chromatograph as well as with a source of carrier gas. A shut-off valve is provided intermediate the separating column inlet and the needle and carrier gas source. Initially, the shut-off valve is opened and carrier gas passes through the needle into the head space above the liquid level of the sample liquid until the pressure of the carrier gas source is obtained within the head space. Under pressure equalization, carrier gas flow is stopped for a predetermined period of time by closing shut-off valve. As a result, the pressure at the separating column inlet decreases and the excess pressure prevailing in the head space causes sample vapour and carrier gas to flow from the head space in the sample vial through the needle toward the separating column inlet. The partial pressures within the head space of the respective components in the sample are proportional to the concentration of the components in the liquid sample. Consequently the chromatogram of the head space enables identification of the concentrations of the respective components in the sample.

Conventional sample vials for head space analysis have closures including rubber discs formed of butyl rubber. Butyl rubber discs, however, are neither sufficiently temperature stable nor satisfactorily chemically inert. For example, at temperatures above 80 degrees centigrade, butyl rubber discs give off volatile components which generate a background in the chromatogram and render any high sensitivity measurements impossible. Furthermore, butyl rubber discs have a high permeability for non-polar organic compounds, e.g. hydrocarbons, and consequently the composition of the sample enclosed in the sample vial may change.

To avoid these difficulties, rubber discs made from temperature stable silicon rubber have been utilized for the septum. These discs are laminated with a thin polytetrafluoroethylene layer on the side facing the interior of the sample vial. The silicon rubber seals about the needle upon penetration and during the metering operation and is self-sealing after removal of the needle from the sample vial. The silicon rubber also provides the required mechanical strength. The thin polytetrafluoroethylene layer, e.g. having a thickness of 0.05 to 0.1 mm, forms a chemically inert barrier layer for preventing entry of volatile silicon rubber components into the sample as well as outward diffusion of volatile sample components through the silicon rubber. Usually, these rubber discs are retained on the sample vial by a metal cap having a central aperture, the metal cap having a rim deformed to grip about a circumferential bead at the neck of the sample vial.

The foregoing described closures, however, are not sealed against high pressures since the rubber discs, while retained by the metal caps, are not pressed against the necks of the sample vials. The usually flat rim of the vial is not sufficiently planar to form a high pressure seal. Rather, it has grooves or flutes due to its manufacturing process which preclude sealing at high pressures.

It is desirable however, to utilize the head space method within a fairly wide range of temperatures, for example up to 190 degrees centigrade. Increased pressures will thus be obtained in the sample vial. Care must be taken to ensure that the closure of the sample vial is tightly sealed to the vial at higher temperatures and pressures. Also, it is necessary to ensure that the limiting strength of the vial is not exceeded so that the vial will not burst or explode because of faulty operation. This may occur, for instance, by placing a sample vial enclosing an aqueous sample into the heating apparatus and heating the sample within the sample vial to temperatures above 190 Centigrade. At these temperatures, the pressures within the sample vial will be about 12 bar and higher. It will readily be appreciated that bursting a sample vial may cause damage to the apparatus as well as expose the operator to danger.

SUMMARY OF THE PRESENT INVENTION

Accordingly, it is a primary object of the present invention to provide a novel and improved closure for a sample vial used in gas chromatography.

It is another object of the present invention to provide a novel and improved sample vial for use in gas chromatography which enables sampling at high temperatures and pressures.

It is still another object of the present invention to provide a novel and improved sample vial for use in gas chromatography which enables the sample vial to vent to atmosphere at a predetermined pressure below the limiting strength of the sample vial.

It is a further object of the present invention to provide a novel and improved sample vial for use in gas chromatography which permits head space analysis at higher temperature ranges then heretofore possible using sample vials of known construction.

Additional objects and advantages of the invention will be set forth in the description which follows and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the closure for a sample vial in accordance with the present invention utilized for introducing sample into a gas chromatograph in conformity with the head space method comprises a flexible disc for closing the opening through the neck of the vial and overlying the margin of the neck about the vial opening, a cap having a central aperture defining an annular shoulder about the aperture for overlying the disc, the cap having an annular depending skirt encompassing the disc for clamping about the neck of the vial to retain the disc and the cap on the vial, and means carried by the closure enabling deformation of at least a part thereof for venting the vial to atmosphere in response to a pressure within the vial when the closure is applied thereto in excess of a predetermined pressure.

Several preferred embodiments of the invention are disclosed herein. In a first embodiment, the Butyl rubber disc includes an annular groove underlying the central aperture in the cap defining a weakened portion of the disc whereby the weakened portion ruptures in response to a pressure within the vial in excess of the predetermined pressure. In a second embodiment, an annular metal disc is disposed between the cap and the butyl rubber disc and has a central aperture defined by an annular knife edge for rupturing the disc in response to a pressure within the vial in excess of a predetermined pressure. In a further embodiment, the skirt of the cap is deformed about the neck of the vial in such a manner that the cap will deform outwardly in response to excess pressure within the vial. In a final disclosed embodiment, the cap is provided with a slot about it's skirt. A disc underlies the cap and overlies the butyl disc whereby the metal cap above the slot bulges upwardly in response to the pressure acting against the butyl disc and the metal disc to vent the vial. Once the vial is vented, and the pressure within the vial lowers to a safe pressure, the annular disc and the butyl disc return to their normal conditions resealing the vial.

The invention consists in the novel parts, constructions arrangements, combinations and improvements shown and described. The accompanying drawings, which are incorporated in and constitute a part of this specification, illustrate one embodiment of the invention and, together with the description, serve to explain the principles of the invention.

BRIEF DESCRIPTION OF THE DRAWINGS

FIG. 1 is a side elevational view of a sample vial with a closure constructed in accordance with the present invention applied thereto and with parts of the vial and closure shown in cross section;

FIG. 2 is a fragmentary view similar to FIG. 1 illustrating a second embodiment of the closure hereof;

FIG. 3 is a view similar to FIG. 2 illustrating a third embodiment of the closure hereof;

FIG. 4 is a perspective view of a still further embodiment of the present invention with the parts thereof illustrated in exploded juxtaposition.

Reference will now be made in detail to the present preferred embodiment of the invention, an example of which is illustrated in the accompanying drawings.

Referring now to FIG. 1, there is illustrated a sample vial, designated 10, having a constricted or reduced diameter neck 12. The margin of neck 12 defining the opening to sample vial 10 has an enlarged diameter bead 13 defining an upper or top annular surface or rim 14 and two surfaces 15 and 17 spaced one from the other by a cylindrical surface 19 (FIG. 4). The top rim 14 defines a seat for a rubber sealing disc 16. Disc 16 is formed preferably of silicon rubber and has a layer or coating 18 on its underside and is preferably formed of polytetrafluoroethylene. Thus, when the disc 16 is sealed to the vial, the polytetrafluoroethylene layer 18 seats along the rim 14 to seal the vial.

The rubber disc 16 is retained on vial 10 by a metal cap 20 having a central aperture 22. Cap 20 is preferably formed of aluminum and includes a rim or skirt 24 which depends from the annular portion of the cap defining central aperture 22 to grip or extend about the enlarged diameter bead 13 formed at the neck 12 of sample vial 10. That is, the depending skirt 24 may be crimped about the bead 13 under the lower surface 19 to retain the butyl rubber sealing disc 16 in sealing relation on annular surface 14 thus closing the vial.

Referring now particularly to the embodiment of the closure illustrated in FIG. 1, the rubber disc 16 is preferably provided with a grooved portion located within the confines of an underlying central aperture 22 of metal cap 20. Preferably, the groove 28 is annular in shape and is dimensioned such that the rubber disc will tear or rupture at this weakened portion to vent the vial to atmosphere in response to a pressure within the vial, when the closure is affixed thereto, in excess of a predetermined pressure. This pressure at which the disc will be ruptured is of course safely below the limiting strength of the sample vial 10.

In the embodiment of the closure of the present invention illustrated in FIG. 2, like components of the vial and the closure are assigned like reference numerals followed by the letter notation "a". In this embodiment, an annular disc 30, formed of a substantially rigid material such as metal, is disposed intermediate the cap **20*a* and the butyl rubber disc 16*a*. Disc 30 is provided with a separate central aperture 32 defined by a sharpened knife edge or margin 33 about aperture 32. Consequently, should the pressure within the interior of the sample vial exceed a predetermined pressure, the disc 16 will be biased outwardly with the result that central portion of the disc 16 will enter the aperture 32. When this occurs, the knife edge 33 defining the aperture will shear or form weakened portions in the disc 16** such that the disc will rupture or tear upon application of a predetermined pressure.

Referring now to the embodiment of the closure hereof illustrated in FIG. 3, like reference numerals are applied to like parts of the vial and closure as illustrated in FIG. 1 followed by the letter notation "b". In this embodiment, the skirt **24*b* of the cap 20*b* terminates in a reduced frustoconical margin 34. The force necessary to deform the frustoconical margin 34** outwardly is correlated to the pressure within the vial such that when a predetermined pressure in the vial is exceeded, the cap and disc will be displaced upwardly from the vial neck to vent the vial.

Referring now to the embodiment of the closure illustrated in FIG. 4, like reference numerals are applied as in the embodiment of FIG. 1 followed by the letter notation "c". In this embodiment, the skirt **24*c* of the cap 20*c* is provided with an arcuate slot 42. Along this margin adjacent the annular top of cap 20*c*, slot 42 extends in a plane common to the annular top. A resilient annular disc 44 having a central aperture 46 is disposed between cap 20*c* and the rubber disc 16*c*. The annular disc 44 is smaller in diameter than the diameter of the skirt portion of metal cap 20*c* and is centered within the skirt portion by a plurality of radial projections 48. The resilient annular disc 44 stabilizes the relatively soft metal cap 20*c* against bulging due to pressure within the sample vial and simultaneously supports the pressing force exerted by metal cap 20*c* on the top of the vial. In the event excess pressure, for example 6–8 bar, obtains within the vial, the rubber disc 16*c* will be urged upwardly by the pressure within the sample vial against the force of the annular disc 44 and metal cap 20*c*. Metal cap 20*c*, which is weakened in the area of the slot 42, will bulge upwardly at that point and the slot will become slightly opened or wider. When this occurs, the disc 16***c* will have been deflected upwardly from the margin of the neck by a slight distance and will develop a leak at this point intermediate the neck and the disc. This leak thus vents the vial to atmosphere and provides a pressure balance until the force of the resilient annular disc 44 and metal cap 20*c* overcomes the force generated by the pressure within the vial. The disc will thereupon return into sealing engagement with the margin about neck 12*c* to reseal the disk to the neck and reseal the vial. Thus, the closure in this embodiment acts in the nature of a pressure limiter. That is, after the excess pressure has been vented and a pressure balance is achieved, the sample vial is resealed without the closure becoming damaged or otherwise unusable.

It will be appreciated from the foregoing that the objects of the present invention are fully accomplished in that there has been provided a closure for a sample vial for use in a gas chromatographic instrument wherein the closure has portions which are deformable for venting the vial to atmosphere in response to a pressure within the vial in excess of a predetermined pressure. In the first two embodiments of the closure of the present invention, the sealing disc is torn or ruptured in response to pressures within the vial in excess of a predetermined pressure whereby the closure is no longer useful for sealing the vials for use in the gas chromatograph. However, the danger of the vials bursting or exploding is avoided. In the embodiment illustrated in FIG. 3, the closure vents the vial in response to a pressure in excess of a predetermined pressure and similarly as in the embodiments of FIGS. 1 and 2, renders the vial unusable for further use in the gas chromatograph. In the embodiment of FIG. 4 however, the closure serves as a pressure limiter whereby the vial may be repeatedly vented in response to pressures within the vial in excess of the predetermined pressure. In this form the vial is useful for analysis in the gas chromatograph.

It will be apparent to those skilled in the art that various modifications and variations could be made in the closure of the present invention without departing from the scope or spirit of the invention.

What is claimed is:

1. A closure for a sample vial utilized for introducing a sample into a gas chromatograph in accordance with the head space method comprising:

a flexible disc for closing the opening through the neck of a sample vial and overlying the margin of said neck about said opening;

a cap having a central aperture defining an annular shoulder about said aperture for overlying said disc, said cap having an annular depending skirt encompassing said disc for clamping about said neck of said vial to retain said disc and said cap on said vial; and means carried by said cap enabling deformation of at least a part of the skirt portion thereof for venting said vial to atmosphere in response to a pressure, which is in excess of a predetermined pressure, within said vial when said closure is affixed thereto.

2. A closure according to claim 1 wherein said vent means includes a conical section of said skirt for underlying the margin about the neck of the vial opening, said conical section being adapted to retain said cap and said disk on the neck of the vial and to deform outwardly to vent the vial in response to pressures in the vial acting on said disc and said cap in excess of said predetermined pressure.

3. A closure according to claim 1 wherein said vent means includes an opening formed through the skirt of said cap adjacent it's top portion, said cap being deformable adjacent said opening in response to pressure acting on said disc and said cap in excess of said predetermined pressure to vent the head space to atmosphere.

4. A closure according to claim 3 including an annular disc having a central aperture in registry with the first mentioned aperture and disposed between said cap and said flexible disc for returning said disc into sealing engagement with the neck of the vial in response to pressures within the vial lower than the predetermined pressure.

* * * * *